US005375577A

United States Patent [19]

Betts, Jr. et al.

[11] Patent Number: 5,375,577

[45] Date of Patent: Dec. 27, 1994

[54] APPARATUS AND METHOD FOR CONTROLLING ENGINE RESPONSE VERSUS EXHAUST SMOKE

[75] Inventors: Edward H. Betts, Jr., Chillicothe; William A. Calliss, Washington, both of Ill.; Phillip J. Houtz, Lafayette, Ind.; Clark C. Schweigert, Tremont, Ill.; Steven C. Swanson, Peoria, Ill.; Shawn J. Weck, Edwards, Ill.; Brian R. Weller, Lafayette, Ind.

[73] Assignee: Caterpillar Inc., Peoria, Ill.

[21] Appl. No.: 96,742

[22] Filed: Jul. 23, 1993

[51] Int. Cl.[5] ..... F02D 41/26

[52] U.S. Cl. ..... 123/480; 123/486

[58] Field of Search ..... 123/478, 480, 486

[56] References Cited

U.S. PATENT DOCUMENTS

| | | | |
|---|---|---|---|
| Re. 32,156 | 5/1986 | Tokuda et al. | 123/480 |
| 4,368,705 | 1/1983 | Stevenson et al. | 123/357 |
| 4,428,354 | 1/1984 | Sundeen et al. | 123/571 |
| 4,469,074 | 9/1984 | Takao et al. | 123/480 |
| 4,556,943 | 12/1985 | Pauwels et al. | 123/480 |
| 4,600,993 | 7/1986 | Pauwels et al. | 123/412 |
| 5,024,196 | 6/1991 | Ohuchi | 123/339 |
| 5,086,739 | 2/1992 | Frankle | 123/357 |
| 5,289,807 | 3/1994 | Yonekawa | 123/339 |

*Primary Examiner*—David A. Okonsky
*Attorney, Agent, or Firm*—R. Carl Wilbur

[57] ABSTRACT

An engine control system is provided which calculates an optimum air/fuel ratio by minimizing the smoke produced by the engine while at the same time maximizing the engine response time for all altitudes over which the engine operates. The control system includes a microprocessor, an ambient pressure sensor, fuel injectors, and storage means. A manual adjustment is provided that allows an operator to manually adjust the air/fuel ratio within certain pre-defined limits of the optimum value.

24 Claims, 3 Drawing Sheets

10
AMBIENT PRESSURE SENSOR
25
A/D
26
A/D
21
20
(MANIFOLD PRESSURE SENSOR)
ENGINE
DRIVER CIRCUITRY
46
40
(INJECTORS)
27
A/D
28
MICROPROCESSOR
12
14
MEMORY
DATA
INSTRUCT
30
31
32
13
MANUAL AIR FUEL RATIO ADJUSTMENT
35
36

APPARATUS AND METHOD FOR CONTROLLING ENGINE RESPONSE VERSUS EXHAUST SMOKE

TECHNICAL FIELD

The present invention relates to an apparatus and method for controlling the air fuel ratio to an engine. More specifically, the present invention relates to an apparatus and method for selecting an air/fuel ratio that optimizes engine response time while minimizing exhaust smoke for any altitude within the engine's operating range.

BACKGROUND OF THE INVENTION

Typically, the response time of a Diesel engine (i.e., the amount of time that an engine requires to go from idle to a certain pre-selected speed) is a function of the air/fuel ratio. Decreasing the air/fuel ratio generally will decrease the response time. However, the decreased response time comes at the expense of increased exhaust smoke. Decreasing the air/fuel ratio increases the smoke produced by the engine. In many mining operations the vehicles are operated in large pits and excessive smoke may accumulate in the pits making it difficult to see. It would therefore be advantageous to make an air/fuel ratio control that optimized the air/fuel ratio for these two variables.

In addition, an optimum air/fuel ratio may change at different altitudes. At higher altitudes, the amount of oxygen present in a given volume of air is less than the amount of oxygen present in the same volume of air at a lower altitude. Thus, to maintain the proper air/fuel ratio at higher altitudes, the engine must compensate for the reduced oxygen content by increasing the volume of air mixed with the fuel or by reducing the amount of fuel in the mixture. One method for accomplishing this is to limit the rack position of the engine when it is operating at higher altitudes. One such method for limiting rack position as a function of altitude is disclosed in U.S. Pat. No. 4,368,705. However, that disclosure does not include a calculation of the optimum air/fuel ratio for response time versus smoke in terms of the vehicle altitude.

The present invention is directed toward overcoming one or more of these drawbacks.

SUMMARY OF THE INVENTION

A preferred embodiment of the control system of the present invention includes a microprocessor; an ambient pressure sensor having an ambient pressure signal as an output to the microprocessor; a fuel injector electrically connected with the microprocessor; and storage means electrically connected to the microprocessor, for storing data points corresponding to an optimum air/fuel ratio in terms of engine response versus exhaust smoke.

A method of calculating an optimum air/fuel ratio for an engine in terms of engine response versus exhaust smoke in connection with an engine control system having an ambient air pressure sensor, an inlet manifold pressure sensor, a microprocessor, storage means, a fuel injector, and an engine, wherein the ambient air pressure sensor produces an ambient air pressure signal and the inlet manifold pressure sensor produces an inlet manifold pressure signal, is disclosed which comprises the steps of: calculating an altitude as a function of the ambient air pressure signal; calculating an optimum air/fuel ratio in terms of exhaust smoke versus engine response based on data points stored in the storage means; and issuing a fuel delivery command.

The foregoing and other aspects of the present invention will become apparent from the following detailed description, in conjunction with the drawings and the claims.

DETAILED DESCRIPTION OF THE INVENTION

Figure 1:
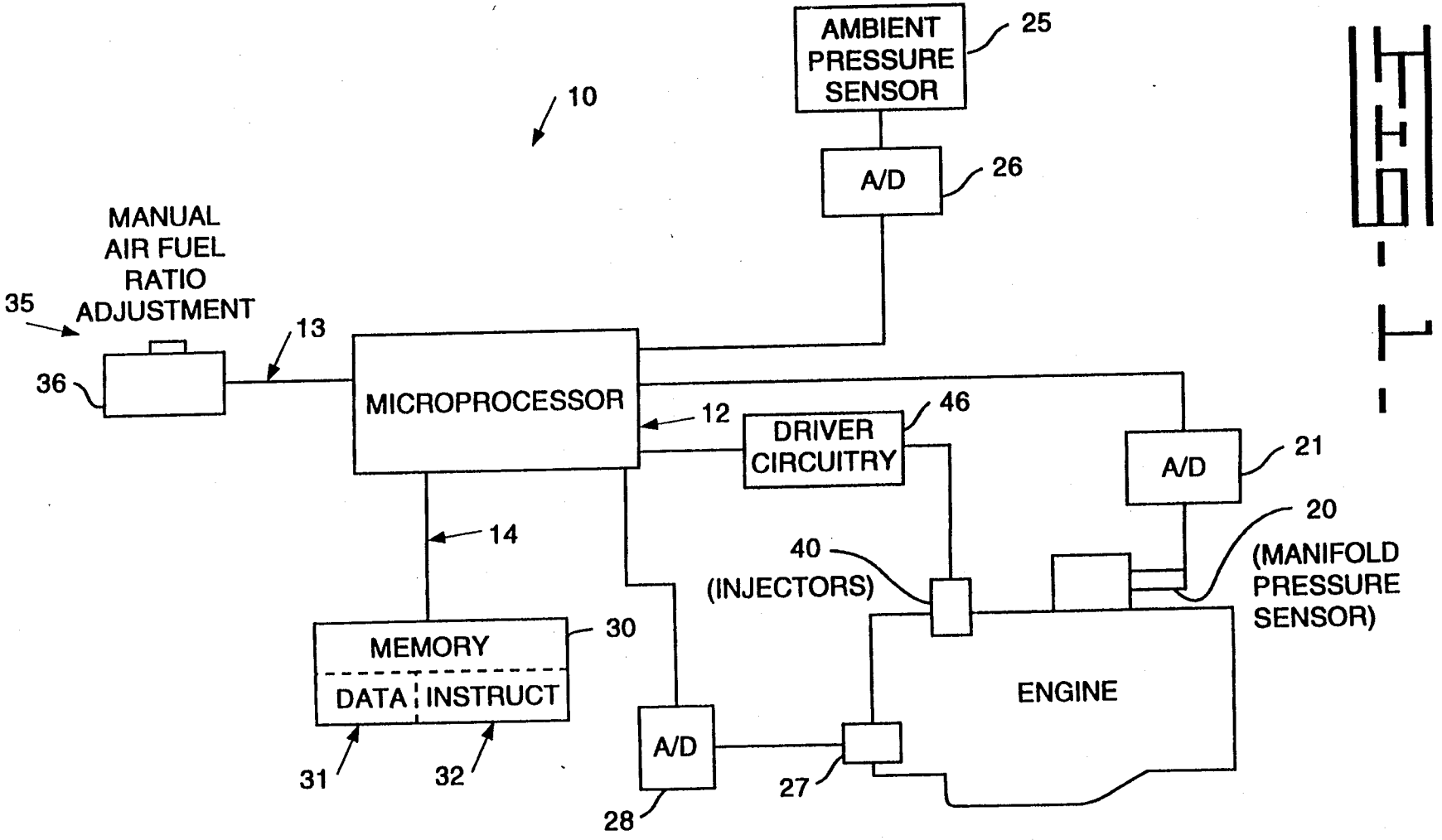
FIG. 1 generally illustrates, in block diagram form, a preferred embodiment of the air/fuel ratio control of the present invention.

Referring to FIG. 1, a preferred embodiment of the control system 10 of the present invention is shown in block diagram form. The control system 10 includes a microprocessor 12 that is connected to an ambient pressure sensor 25 through an analog to digital (A/D) converter 26 and to a coolant temperature sensor 27 through an A/D converter 28. The microprocessor 12 is connected to an inlet manifold pressure sensor 20 through an A/D converter 21, and individual injectors 40 through solenoid driver circuitry 46. The signal conditioning and filtering circuitry associated with these circuits is not shown, but is well known in the art.

Also connected to the microprocessor is a manual adjustment feature 35, which is shown as a slide switch 36 in the preferred embodiment. Although the manual adjustment 35 is shown as a slide switch 36, one skilled in the art could readily and easily substitute other known adjustment means for a slide switch 36. A discrete memory device 30 including software instructions 32 and air/fuel ratio data 31 has an input 14 to the microprocessor 12. In the preferred embodiment, the memory device 30 is shown as a discrete device. However, it is well known in the art to include memory 30 within a microprocessor 12.

The microprocessor 90 used in the preferred embodiment is a Motorola 6811E2 microprocessor, manufactured by Motorola Semiconductor Products, Inc. located in Phoenix, Ariz. However, other suitable microprocessors known in the art can be readily and easily substituted.

Figure 2:
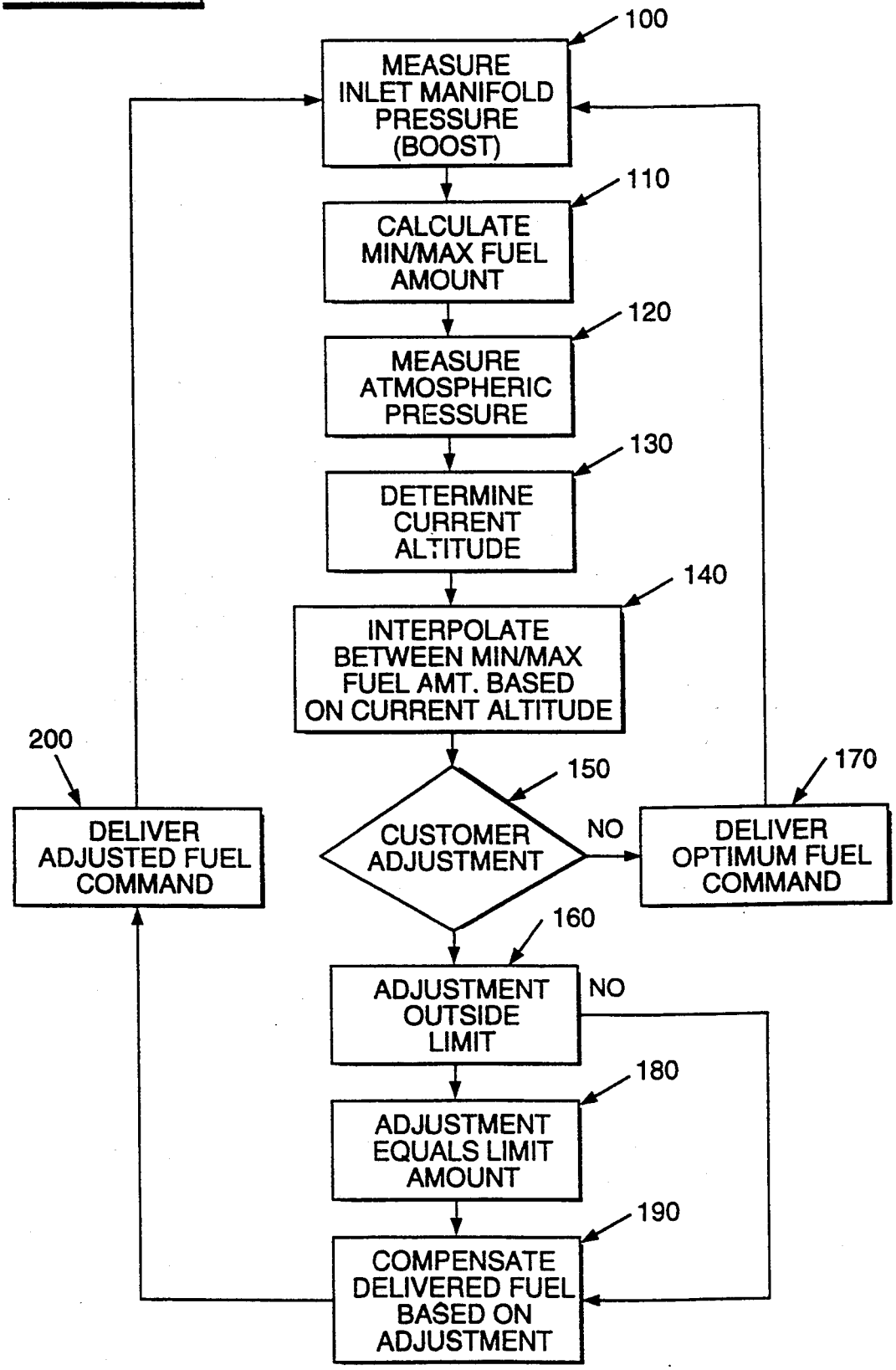
FIG. 2 illustrates a flow chart of the software operation of the control system.

Referring now to FIG. 2, a flow chart shows the microprocessor control performed according to the software instructions 32 stored in the memory device 30. The detailed flowchart depicted is particularly well adapted for use with the microprocessor identified above, although any microprocessor may be used in practicing the present invention. The flowchart represents a complete and workable design of the preferred software program, and has been reduced to practice on the series 6811E2 microprocessor. The software may be readily coded from this flowchart using the instruction set associated with this microprocessor, or the instruction set of other suitable microprocessors. Writing the software from this flowchart is a mechanical step for one skilled in the art.

In the first block 100, the inlet manifold pressure sensor 20 produces an analog inlet manifold pressure signal (a boost pressure) that is converted into a digital signal by the A/D converter 21. In block 110 the microprocessor 12 calculates a minimum and maximum amount of fuel that can be combined with the specific quantity of air at that boost pressure. The minimum and maximum fuel amounts are empirically determined and are based on the elevation extremes over which the engine is programmed to operate. In the preferred embodiment the minimum air/fuel ratio is 12.0 to 1 and the maximum air/fuel ratio is 18 to 1. These minimum and maximum values can be readily and easily changed by one skilled in the art so that the control can be used on a variety of engines.

In block 120, the ambient pressure sensor 25 produces an analog ambient pressure signal corresponding to the existing ambient air pressure. The A/D converter 26 converts the analog signal to a digital signal which is then received by the microprocessor 12. In block 130, the microprocessor 12 calculates the engine's altitude based on the ambient pressure signal produced by the ambient pressure sensor 25.

Figure 3:
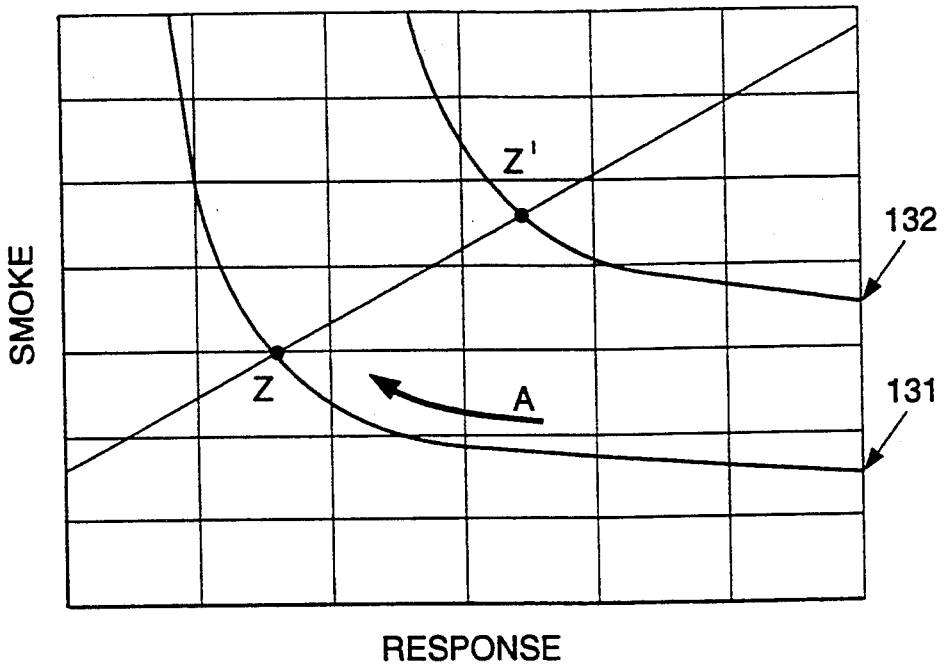
FIG. 3 graphically illustrates a typical air/fuel ratio response curve for two altitudes.

In block 140, the microprocessor calculates the optimum air/fuel ratio based on the data 31 stored in memory. A typical set of data points is shown in FIG. 3., which generally shows two air/fuel ratio curves. Each curve represents smoke versus response time for a specific operating altitude. Referring to FIG. 3, as the air/fuel ratio decreases at one of the specific altitudes, the response time increases and the amount of exhaust smoke decreases. Thus, when the air fuel ratio is very lean the exhaust smoke characteristics are desirable, but the response time is very slow. As the air/fuel ratio increases (shown in FIG. 3 by arrow A), the response time decreases, but the amount of smoke increases. As can be seen, exhaust smoke and response time are inversely proportional.

As shown in FIG. 3, in the preferred embodiment, two air/fuel ratio curves are stored in memory. A first set of data points 131 represents engine response time versus exhaust smoke for various air/fuel ratios when the engine is operated at or below a first altitude. A second set of data points 132 shows various engine response time versus exhaust smoke for air/fuel ratios when the engine is operating at or above a second altitude. The optimum engine response time versus exhaust smoke at or below the first altitude is graphically represented by point Z. This first set of data points 131 is stored in memory 30.

The optimum air/fuel ratio for operating altitudes at or above the second altitude is graphically represented by point Z' in FIG. 3. This second set of data points 132 is also stored in memory 30. Given these two sets of data points the microprocessor can calculate the optimum air/fuel ratio for a given altitude between the first and second altitudes by piece-wise linear interpolation. Referring to FIG. 2, in block 140, the microprocessor calculates the optimum air/fuel ratio for the current operating altitude as sensed by the ambient air pressure sensor 25.

Figure 4:
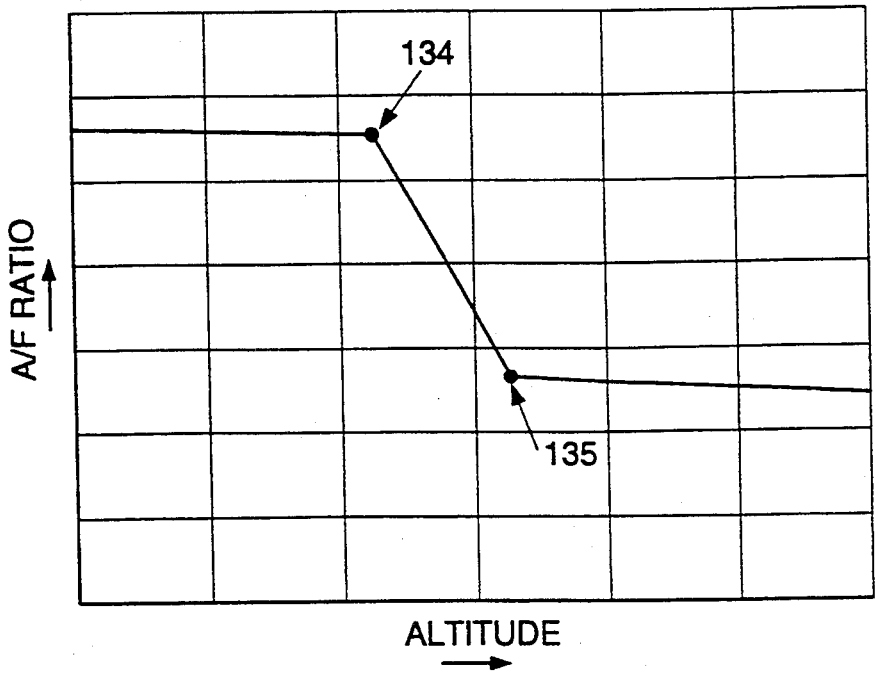
FIG. 4 graphically illustrates typical optimum air/fuel ratios versus altitude.

Referring to FIG. 4, a graph of the optimum air/fuel ratio versus altitude is shown. Reference point 134 represents the first altitude corresponding to the first set of data points 131. Reference point 135 represents the second altitude corresponding to the second set of data points 132. As described above the optimum air/fuel ratios between the first and the second altitudes are calculated through piece-wise interpolation from the first and second sets of data points.

Referring again to FIG. 2, once the microprocessor 12 calculates the optimum air fuel ratio, in block 150 the microprocessor reads the input 13 from the slide switch 36. The operator moves the slide switch 36 from a center position if he or she desires to vary the air/fuel ratio from the calculated optimum value. If the microprocessor 12 detects that the operator has moved the slide switch to a position other than the center position, then program control will proceed to block 160. If the operator has not moved the slide switch 36 to a position other than the center position, then no adjustment to the optimum air/fuel ratio is desired and control passes to block 170.

In block 170, the microprocessor issues a fuel command to the driver circuitry 46. The driver circuitry 46 controls the duration of the current flowing to the injector 40 as a function of the microprocessor 12 fuel command. The current flow to the injector 40 determines the length of time that an injector remains open which, in turn, determines the amount of fuel entering a cylinder.

If the operator has commanded an adjustment to the optimum fuel amount, then in block 160 the microprocessor determines whether the adjustment amount is outside a pre-set adjustment limit. If the adjustment amount is outside the pre-set limit, then control passes to block 180 where the adjustment amount is set to the limit amount.

In a preferred embodiment, the adjustment limit has two parts. First, there are absolute upper and lower air/fuel ratio limits which, as noted above, in the preferred embodiment are 18 to 1 and 12.0 to 1 respectively. Second, there is a relative limit that is calculated as 25% of the range between the upper and lower absolute limits. Thus, in the preferred embodiment, the relative limits are a +/−1.5 to 1 change in the air/fuel ratio.

As an example of the relative limits, assume that the optimum calculated air/fuel ratio for a given altitude is 16.5 to 1. The operator can decrease response time by manually adjusting the air/fuel ratio to as low as 15.0 to 1. The operator can also decrease the smoke output by manually adjusting the air/fuel ratio to as high as 18 to 1.

However, the operator cannot manually adjust the air/fuel ratio beyond one of the absolute limits. Thus, if the calculated optimum air/fuel ratio was 17.5 to one, the most that the operator could increase the air/fuel ratio would be 0.5 to 1, for a total of 18 to 1. However, the operator could decrease the ratio the full 1.5 to 1, to a minimum of 16.0 to 1.

Referring to block 190, the optimum air/fuel ratio is adjusted by the adjustment amount. Control passes to block 200 where the microprocessor issues a fuel command corresponding to the optimum value adjusted by the adjustment amount. Program control then returns to block 100.

An additional control step, not illustrated in FIG. 2, may be included in a preferred embodiment. Prior to commencing the control sequence illustrated by the block diagram in FIG. 2, the microprocessor 12 reads the output of the A/D converter 28, which produces a digital signal corresponding to the analog temperature signal of the coolant temperature sensor 27. If the coolant temperature is less than a pre-determined value, the optimum air-fuel ratio as determined according to the software control described above will be reduced by a pre-determined percentage, but in no event will the air-fuel ratio fall below the absolute lower limit. In this manner, the control system can also reduce excess smoke resulting from operating the vehicle in a cooler conditions.

INDUSTRIAL APPLICABILITY

A preferred embodiment of the present invention provides an air/fuel ratio control that optimizes the air/fuel ratio to reduce exhaust smoke without unduly sacrificing engine performance. The control can be used to reduce the exhaust smoke produced by vehicles operating in mining pits or other areas where exhaust smoke might tend to collect.

We claim:

1. An engine system comprising:

a microprocessor;

an ambient pressure sensor having an ambient pressure signal as an output to the microprocessor;

a fuel injector associated with an output of said microprocessor;

an inlet manifold pressure sensor connected to the microprocessor, and producing an inlet manifold pressure signal;

a manual adjustment mechanism connected to the microprocessor, and producing a manual adjustment signal; and storage means connected to the microprocessor, for storing data points corresponding to an optimum air/fuel ratio in terms of engine response versus exhaust smoke as a function of the ambient pressure signal;

wherein said microprocessor issues a fuel delivery command as a function of said optimum air/fuel ratio, said inlet manifold pressure signal, and said manual adjustment signal.

2. An engine control system according to claim 1 wherein the microprocessor issues a fuel delivery command to the fuel injector.

3. An engine control system according to claim 2 wherein the fuel delivery command corresponds to an optimum air/fuel ratio.

4. An engine control system according to claim 1 including: an engine coolant temperature sensor adapted to produce an engine coolant temperature signal; and wherein said microprocessor is adapted to receive said engine temperature signal.

5. An engine control system according to claim 4 wherein the microprocessor issues a fuel delivery command to the fuel injector.

6. An engine control system according to claim 5 wherein he fuel delivery command corresponds to an optimum air/fuel ratio.

7. An engine control system according to claim 5 wherein the fuel delivery command is a function of the optimum air/fuel ratio and an adjustment amount.

8. An engine control system according to claim 7 wherein the fuel delivery command is a function of the inlet manifold pressure signal.

9. An engine control system according to claim 1 wherein the microprocessor calculates an altitude as a function of the ambient air pressure sensor signal.

10. An engine control system according to claim 9 wherein said storage means further includes data points corresponding to an optimum air/fuel ratio in terms of engine response versus exhaust smoke for a first altitude.

11. An engine control system according to claim 10 wherein said storage means further comprises second data points corresponding to an optimum air/fuel ratio in terms of engine response versus exhaust smoke for a second altitude.

12. An engine control system according to claim 11 wherein the microprocessor calculates an optimum air/fuel ratio for altitudes between the first and the second altitude by interpolating from the first and second data points.

13. An engine control system according to claim 12 including an engine coolant temperature sensor adapted to produce an engine coolant temperature signal, wherein said microprocessor is adapted to receive said engine coolant signal.

14. An engine control system according to claim 13 wherein said microprocessor reduces said optimum air/fuel ratio by a predetermined percentage in response to said engine coolant temperature signal being less than a predetermined value.

15. An engine control system, comprising:

an engine;

a manifold pressure sensor associated with said engine and producing a manifold pressure signal;

a fuel injector associated with said engine;

an ambient air pressure sensor adapted to produce an ambient air pressure signal;

a manual air/fuel ratio adjustment having a manual adjustment signal;

an engine coolant temperature sensor adapted to produce an engine coolant temperature signal;

control means adapted to receive the manifold pressure signal, the ambient air pressure signal, the manual adjustment signal, the engine coolant temperature signal, to calculate an optimum air/fuel ratio, and to output a fuel command to the fuel injector corresponding to said calculated optimum ratio.

16. An engine control system according to claim 15, including storage means connected to said control means.

17. An engine control system according to claim 16 wherein said storage means further includes data points corresponding to an optimum air/fuel ratio in terms of engine response versus exhaust smoke for a first altitude.

18. An engine control system according to claim 17 wherein said storage means further comprises second data points corresponding to an optimum air/fuel ratio in terms of engine response versus exhaust smoke for a second altitude.

19. An engine control system according to claim 18 wherein the control means calculates an optimum air/fuel ratio for altitudes between the first and the second altitude by interpolating from the first and second data points.

20. An engine control system according to claim 19 wherein the control means reduces said optimum air/fuel ratio by a predetermined percentage in response to said engine coolant temperature signal being less than a predetermined value.

21. A method of calculating an optimum air/fuel ratio for an engine in terms of engine response versus exhaust smoke in connection with an engine control system having an ambient air pressure sensor, an engine coolant temperature sensor, an inlet manifold pressure sensor, a microprocessor, storage means, a fuel injector, and an engine, wherein the ambient air pressure sensor produces an ambient air pressure signal and the inlet manifold pressure sensor produces an inlet manifold pressure signal, comprising the steps of:

calculating an altitude as a function of the ambient air pressure signal;

calculating an optimum air/fuel ratio in terms of exhaust smoke versus engine response based on data points stored in the storage means;

reading a signal from a manual adjustment switch;

calculating a manual adjustment to said optimum air/fuel ratio as a function of said step of reading; and issuing a fuel delivery command wherein the command is a function of the optimum air/fuel ratio, the inlet manifold pressure signal, and said signal from said manual adjustment switch.

22. A method of calculating an optimum air/fuel ratio according to claim 21, wherein the step of calculating an optimum air/fuel ratio includes the steps of interpolating between a first and a second set of data points.

23. A method of calculating an optimum air/fuel ratio according to claim 22 including the step of sensing the engine coolant temperature.

24. A method of calculating an optimum air fuel ratio according to claim 23 including the step of reducing the calculated optimum air/fuel ratio in response to said sensed engine coolant temperature being less than a pre-determined value.

* * * * *

UNITED STATES PATENT AND TRADEMARK OFFICE

CERTIFICATE OF CORRECTION

PATENT NO. : 5,375,577

DATED : December 27, 1994

INVENTOR(S) : Edward H. Betts, Jr. et al.

It is certified that error appears in the above-identified patent and that said Letters Patent is hereby corrected as shown below:

Column 5, claim 6, line 51, delete "he" and insert --the--.

Signed and Sealed this

Twenty-fifth Day of April, 1995

*Attest:*

Bruce Lehman

BRUCE LEHMAN

*Attesting Officer*

*Commissioner of Patents and Trademarks*